US007137738B2

(12) United States Patent
Shah et al.

(10) Patent No.: US 7,137,738 B2
(45) Date of Patent: Nov. 21, 2006

(54) RECLOSEABLE STORAGE BAG WITH POROUS EVACUATION PORTAL

(75) Inventors: Ketan N. Shah, Gurnee, IL (US); Kenneth S. Nurkiewicz, Racine, WI (US); John O. McCree, Bay City, MI (US); Peggy B. Winiarski, Franksville, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 277 days.

(21) Appl. No.: 10/823,261

(22) Filed: Apr. 13, 2004

(65) Prior Publication Data

US 2004/0223667 A1 Nov. 11, 2004

Related U.S. Application Data

(62) Division of application No. 10/185,346, filed on Jun. 28, 2002, now abandoned.

(51) Int. Cl.
*B65D 33/01* (2006.01)

(52) U.S. Cl. ..... 383/103

(58) Field of Classification Search ..... 383/100–103; 206/524.8

See application file for complete search history.

(56) References Cited

U.S. PATENT DOCUMENTS

| | | | | |
|---|---|---|---|---|
| 4,134,535 | A * | 1/1979 | Barthels et al. | 383/102 |
| 4,310,118 | A | 1/1982 | Kisida et al. | |
| 4,715,494 | A * | 12/1987 | Heitzenroder et al. | 206/213.1 |
| 5,059,036 | A * | 10/1991 | Richison et al. | 383/61.2 |
| 5,142,970 | A | 9/1992 | ErkenBrack | |
| 5,240,112 | A | 8/1993 | Newburger | |
| 5,407,087 | A | 4/1995 | Giblin et al. | |
| 5,443,851 | A * | 8/1995 | Christie et al. | 426/88 |
| 5,450,963 | A | 9/1995 | Carson | |
| 5,480,030 | A | 1/1996 | Sweeney et al. | |
| 5,492,241 | A | 2/1996 | Barnett et al. | |
| 5,523,236 | A | 6/1996 | Nuzzo | |
| 5,584,409 | A | 12/1996 | Chemberlen | |
| 5,587,192 | A * | 12/1996 | Beizermann | 426/118 |
| 5,692,837 | A | 12/1997 | Beer | |
| 5,829,884 | A | 11/1998 | Yeager | |
| 5,839,582 | A | 11/1998 | Strong et al. | |
| 5,881,881 | A | 3/1999 | Carrington | |
| 5,894,929 | A | 4/1999 | Kai et al. | |
| 5,988,426 | A | 11/1999 | Stern | |
| 5,996,800 | A | 12/1999 | Pratt | |
| 6,039,182 | A | 3/2000 | Light | |
| 6,056,439 | A | 5/2000 | Graham | |
| 6,059,457 | A | 5/2000 | Sprehe et al. | |
| 6,070,397 | A | 6/2000 | Bachhuber | |

(Continued)

FOREIGN PATENT DOCUMENTS

DE 198 43 430 A1 3/2000

(Continued)

OTHER PUBLICATIONS

International Search Report for Application No. PCT/US03/20478; report dated Oct. 1, 2003.

*Primary Examiner*—Jes F. Pascua

(57) ABSTRACT

A recloseable storage bag is disclosed which may include first and second sides having closed sides and an open top. Primary closure members may be provided proximate the top, with a secondary closure element being provided in one of the sides to enable gas to be evacuated from the bag after the primary closure members are closed. The secondary closure member may further include the ability to prevent liquid from exiting the bag therethrough.

12 Claims, 3 Drawing Sheets

U.S. PATENT DOCUMENTS

| | | | | |
|---|---|---|---|---|
| 6,070,728 | A | 6/2000 | Overby et al. | |
| 6,076,967 | A | 6/2000 | Beaudette | |
| 6,120,817 | A | 9/2000 | Archibald et al. | |
| 6,132,089 | A | 10/2000 | Galomb et al. | |
| 6,149,304 | A | 11/2000 | Hamilton et al. | |
| 6,182,850 | B1 * | 2/2001 | Marbler et al. | 220/359.3 |
| 6,194,011 | B1 | 2/2001 | Glaser | |
| 6,231,236 | B1 | 5/2001 | Tilman | |
| 6,274,181 | B1 | 8/2001 | Richison et al. | |
| 6,357,915 | B1 | 3/2002 | Anderson | |
| 6,378,272 | B1 | 4/2002 | Archibald et al. | |
| 6,575,191 | B1 | 6/2003 | Skeens et al. | |
| 6,604,634 | B1 | 8/2003 | Su | |
| 6,634,384 | B1 | 10/2003 | Skeens et al. | |
| 6,692,147 | B1 | 2/2004 | Nelson | |
| 6,729,473 | B1 | 5/2004 | Anderson | |
| 7,004,632 | B1 * | 2/2006 | Hamilton et al. | 383/103 |
| 2002/0043052 | A1 | 4/2002 | Gyorffy | |
| 2003/0066267 | A1 | 4/2003 | Nelson | |
| 2004/0007494 | A1 | 1/2004 | Popeil et al. | |
| 2004/0057636 | A1 | 3/2004 | Ishizaki | |
| 2004/0096128 | A1 * | 5/2004 | Shibata | 383/101 |

FOREIGN PATENT DOCUMENTS

| | | | | |
|---|---|---|---|---|
| EP | 0 729 901 A1 | | 9/1996 | |
| JP | 03212355 | | 9/1991 | |
| JP | 5-124656 | * | 5/1993 | 206/524.8 |
| JP | 8-198274 | | 8/1996 | |

* cited by examiner

RECLOSEABLE STORAGE BAG WITH POROUS EVACUATION PORTAL

CROSS REFERENCE TO RELATED APPLICATION

This Application is a divisional patent application of U.S. patent application Ser. No. 10/185,346, filed on Jun. 28, 2002 now abandoned.

FIELD OF THE DISCLOSURE

The disclosure generally relates to bags and, more particularly, to recloseable food storage bags.

BACKGROUND OF THE DISCLOSURE

Reclosable storage bags are well known, especially with regard to food storage. Such bags are generally made out of a plastic film and have two side walls which are sealed around the edges. Such material is fluid impermeable, relatively inexpensive, and can be manufactured in transparent form thereby facilitating content identification. Accordingly, plastic bags have become the dominant product of choice in the area of food storage bags.

Such bags are typically recloseable and substantially sealable. One common approach to provide such features employs closure members at a top edge of a bag having first and second thermoplastic layers folded or heat sealed along bottom and first and second side edges. The closure members may be provided in the form of mating male and female profiles such as those provided by the present assignee under the ZIPLOC® trademark. The male and female profiles are also typically manufactured from plastic, with the male profile including a linear tab adapted to be interlocked with a linear groove of the female profile.

The male and female profiles can be connected to close the bag by pinching and pulling across the closure members along the length of the top edges. Such motion can be accomplished with the thumb and forefinger of a user, or through the use of a sliding element mounted to the male and female profiles, as is the case with bags provided by the present assignee under the ZIPLOC® trademark as well.

While such bags have been met with extraordinary commercial success from their inception until the present day, the assignee continues to improve its product offerings. One area which the assignee has identified as grounds for improvement involves the ability to evacuate gas from a bag after sealing. While the primary closure found at the top of many plastic bags provides an airtight seal, air remaining enclosed in the bag after closure enables bacterial growth and therefore hinders the preservation and freshness the bags are intended to maintain.

It would therefore be an advance in the art of bags to provide a bag with an evacuation aperture provided with a secondary closure, or valve, for sealing the aperture. In this manner, a bag may be closed at the top using the primary closure member, as described above, and subsequently evacuated of gas and resealed using the aperture and secondary closure, respectively.

SUMMARY OF THE DISCLOSURE

In accordance with one aspect of the disclosure, a recloseable storage bag is disclosed which may include first and second sides attached along bottom, left, and right sides, primary closure members provided proximate top edges, an aperture in one of the sides, and a secondary closure element associated with the aperture. The secondary closure element may be made of a porous material.

In accordance with another aspect of the disclosure, a method of evacuating gas from a recloseable storage bag is disclosed which may include providing a bag, closing the bag using primary closure members positioned at a top of the bag, and compressing the bag to force gas through the aperture and secondary closure element. The bag may have first and second sides connected along first and second side edges. The bag may include a top and a bottom with the bottom being closed and the top being adapted to be opened and closed using the primary closure members. The bag may further include an aperture in at least one of the sides, with the secondary closure element being operatively associated with the aperture and being porous.

In accordance with another aspect of the disclosure, a recloseable storage bag is disclosed which may include a first side, a second side, primary closure members, and means for evacuating gas from the bag after the primary closure members are closed, the means for evacuating including at least one aperture covered by a porous layer.

These and other aspects and features of the disclosure will become more apparent upon reading the following detailed description when taken in conjunction with the accompanying drawings.

Figure 1:
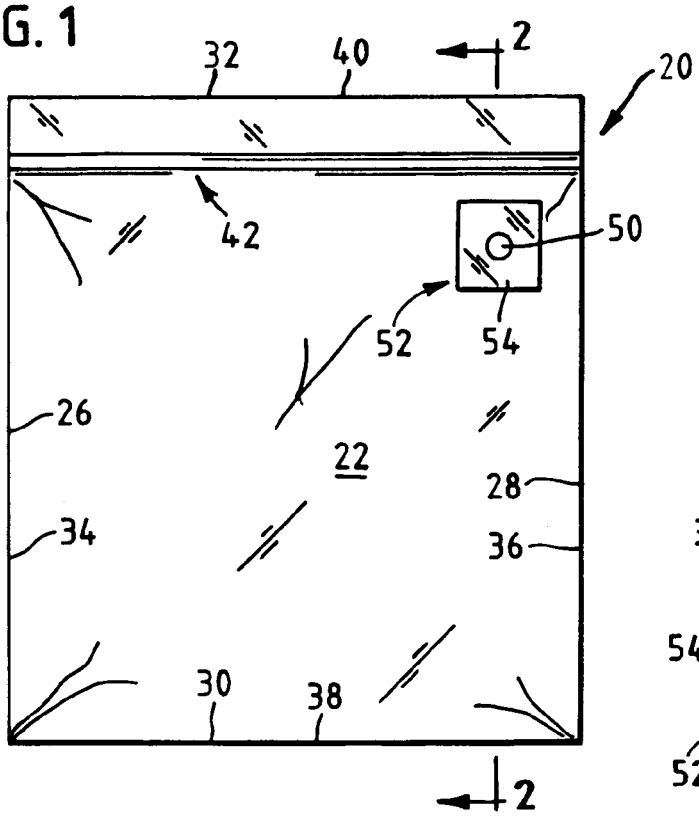
FIG. 1 is a front view of bag constructed in accordance with the teachings of the disclosure.

While the disclosure is susceptible to various modifications and alternative embodiments, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION OF THE DISCLOSURE

Referring now to the drawings, and with specific reference to FIG. 1, a recloseable storage bag constructed in accordance with the teachings of the disclosure is generally referred to by reference numeral 20. While the bag 20 will be described herein with predominant reference to food storage bags such as those sold by the assignee under its ZIPLOC® trademark, it is to be understood that the teachings of the disclosure could be employed in any other type of bag, such as but not limited to bags used to store perishable goods other than food, as well as bags which are not intended to be recloseable.

Figure 2:
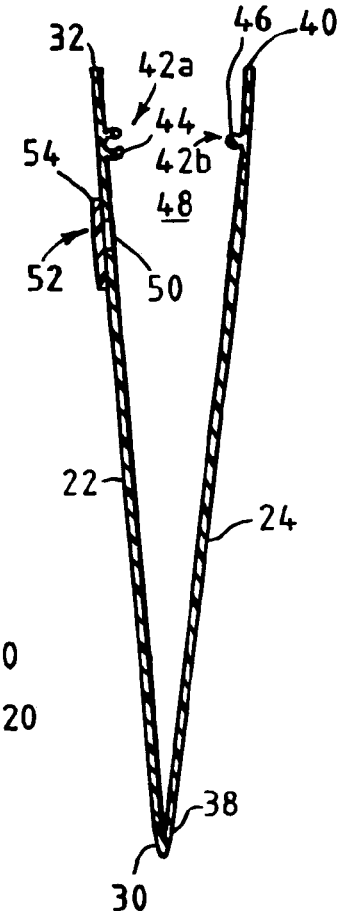
FIG. 2 is sectional view of the bag of FIG. 1 taken along line 2—2 of FIG. 1.

With reference again to FIG. 1, as well as FIG. 2, the bag 20 is shown to include a first side wall 22 joined to a second side wall 24. More specifically, the first side 22 includes a left edge 26, a right edge 28, a bottom edge 30, and a top edge 32, while the second side 24 includes a left edge 34, a right edge 36, a bottom edge 38, and a top edge 40. The respective left edges 26, 34 are joined together, as are the respective right edges 28, 36, and the respective bottom edges 30, 38. By "joined" together, it is to be understood that the edges can be formed by heat sealing, ultrasonic welding, impulsing welding, or the like, or can be integral and simply separated by a fold. As such bags 20 are typically manufactured from polyethylene or similar plastic material, it has been found to be advantageous to form one edge, e.g., the bottom edge, with a fold, and the other two edges, e.g., the left and right edges, with heat seals.

The top edges 32, 40, however, are not permanently closed, but rather are provided with recloseable primary closure members 42*a*, 42*b*. The primary closure elements are depicted in the form of mating male and female profiles, wherein the male profile 42*a* includes three ribs 44, while the female profile includes two ribs 46. As will be readily understood by one of ordinary skill in the art, the primary closure members 42*a*, 42*b* can be joined using a pinch-and-seal motion with the thumb and forefinger. Such pressure causes the ribs 44 and 46 to frictionally intermesh in alternating fashion, thereby substantially sealing the bag. A slider or the like can be provided to facilitate such zipper action. In other embodiments, the primary closure members 42*a*, 42*b* need not be provided in such zipper fashion, but could be provided in any other suitable fashion such as, but not limited to, adhesive fasteners, hook and loop fasteners, invertable folds, buttons, clips, and the like.

In so doing, the bag 20 is formed to have an interior storage space 48 accessible between the top edges 32, 40 when the primary closure members 42*a*, 42*b* are open. After the primary closure members 42*a*, 42*b* are closed, the bag 20 is substantially sealed. In order to remove excess gas, such as air, from the interior storage space 48, an aperture 50 may be provided in one or more of the side walls 22, 24. As shown best in FIG. 2, the aperture 50 may be provided in the first side wall 22 to enable gas to exit the storage space 48 as by compressing the bag 20, or otherwise manipulating the bag 20, to force excess air from the space 48 to the atmosphere through the aperture 50.

The bag 20 may further include a secondary closure element 52 adapted to close the aperture 50. In the embodiment of FIGS. 1 and 2, the secondary closure element 52 is provided in the form of a porous layer 54 positioned over the aperture 50 and attached to the side wall 22. The porous layer 54 may be provided from any suitable material enabling gas to be dissipated therethrough. For example, the porous layer 54 may be provided from a non-woven polymer such as spun bond, melt blown, or spun bond-melt blown-spun bond (SMS) polyethylene. The basis weight of such material may be in the range of 0.1 OSY to 50 OSY. Alternatively, the porous layer 54 may be in the form of a foam of open cell structure, made of polyethylene, or other compatible material. In still further alternatives, the porous layer 54 may be in the form of closed cell polyethylene foam, which is subsequently machined or pierced to be open celled. Other materials such as, but not limited to, other porous polymers, foams, sponges, meshes, and one-way valves, are certainly possible. The porous layer 54 may be any suitable shape such as, but not limited to rectangular and circular, and is only limited in size by the size of the aperture 50.

While the embodiment of FIGS. 1 and 2 will enable excess gas to be expelled from the bag 20 after the primary closure members 42*a* and 42*b* are closed, it may be further advantageous to additionally provide a mechanism by which the liquid within the interior space 48 is substantially prevented from exiting the bag 20 through the aperture 50. For example, if a frozen good is placed within the bag 20, the water resulting from thawing can be prevented from exiting through the aperture 50.

Figure 3:
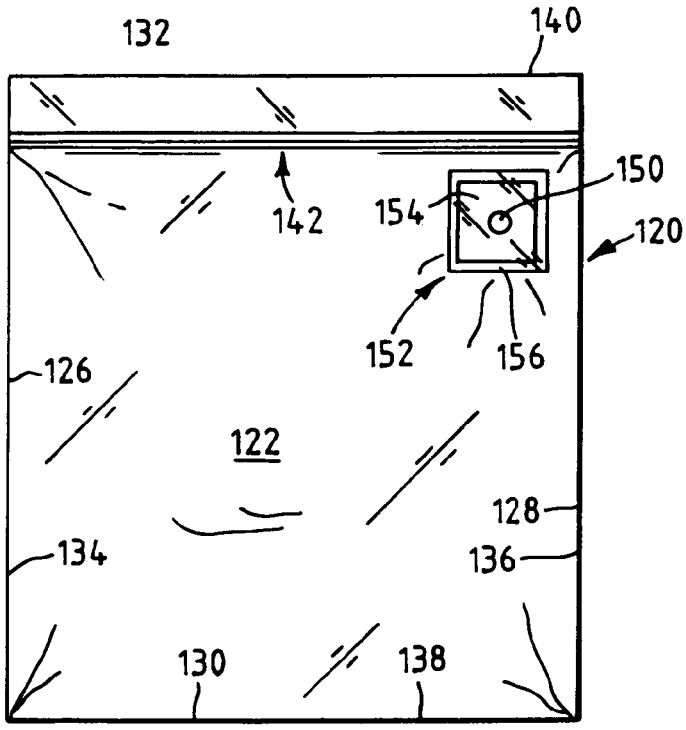
FIG. 3 is a front view of first alternative embodiment of a bag constructed in accordance with the teachings of the disclosure.

One apparatus for doing so is shown in the form of a bag 120 depicted in FIG. 3. As shown therein, the secondary closure member 152 may be further provided with a non-porous layer 156. At this point it is important to note that with regard to the various embodiments disclosed herein, the numbering system will repeat like reference numerals for like elements employed in the various embodiments, with the exception that each embodiment will have its own, sequential prefix. Accordingly, the embodiment of FIG. 3 will use reference numerals having a one hundred series prefix, and later described embodiments will have a two-hundred series prefix, three-hundred series prefix and so on.

The non-porous layer 156 is provided over the porous layer 154, which itself is provided over the bag aperture 150. More specifically, outer edges 158 of the porous layer are joined to the bag 120 over the aperture 150, as by heat sealing, ultrasonic welding, or the like. Similarly, outer edges 160 of the non-porous layer 156 are attached to the bag 120 over the porous layer 154. The non-porous layer 156 is made sufficiently larger than the porous layer 154 to facilitate such attachment.

Figure 4:
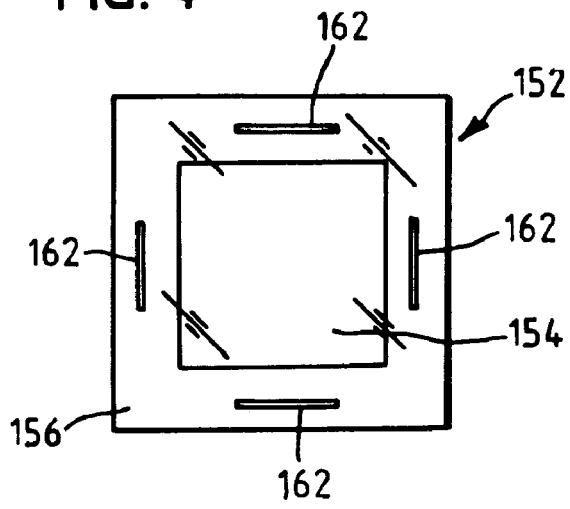
FIG. 4 is an enlarged plan view of the secondary closure element of FIG. 3.
Figure 5:
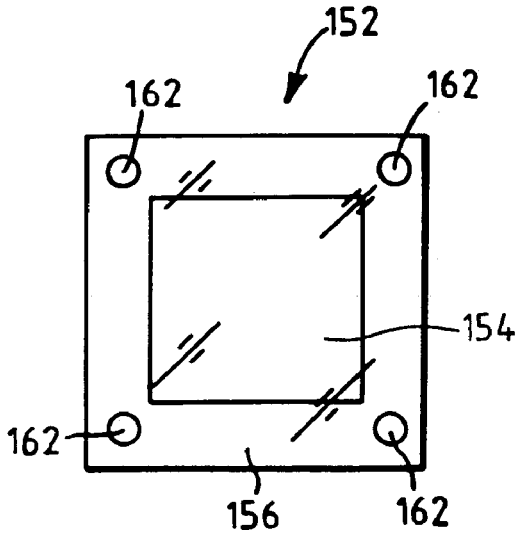
FIG. 5 is an enlarged plan view of an alternative embodiment of the secondary closure element.

Turning now to FIGS. 4 and 5, the non-porous layer 156 is shown in greater detail to include at least one perforation 162. The perforation 162 is provided in a band 164 outside the outer edges 158 of the porous layer 154. In the embodiment of FIG. 4, the perforations 162 are provided in the form of slits, while in the embodiment of FIG. 5, the perforations 162 are provided in the form of circular apertures. Other shapes, as well as their spacings and numbers, are certainly possible. A benefit provided by the perforations 162 is that they assist in forming an air flow passageway from the interior space 148 to the atmosphere through the aperture 150. More specifically, when the bag 120 is compressed with the primary closure members 142*a*, 142*b* closed, the gas within the space 148 is forced first through the aperture, and then through the porous layer 154. As the outer edges 160 of non-porous layer 156 are sealed to the bag 120, the gas pushes the non-porous layer 156 away from the porous layer 154 and exits through the perforations 162.

A benefit of providing the non-porous layer 156 itself is its ability to substantially prevent liquid within the interior space 148 from exiting the bag 120 through the aperture 150. More specifically, if liquid within the interior space 148 attempts to exit the bag 120 through the aperture 150, it first passes through the porous layer 154 and then comes into contact with the non-porous layer 156. Upon contact the porous layer 154 and non-porous layer 156 adhere together due to surface tension. As a result, the liquid cannot access the perforations 162, and thus cannot exit the bag 120. In so doing, it can be seen that the bag 120 is provided both with a means for evacuating air from the bag after primary closing, and means for preventing liquid from exiting the bag through the means for evacuating air.

Figure 6:
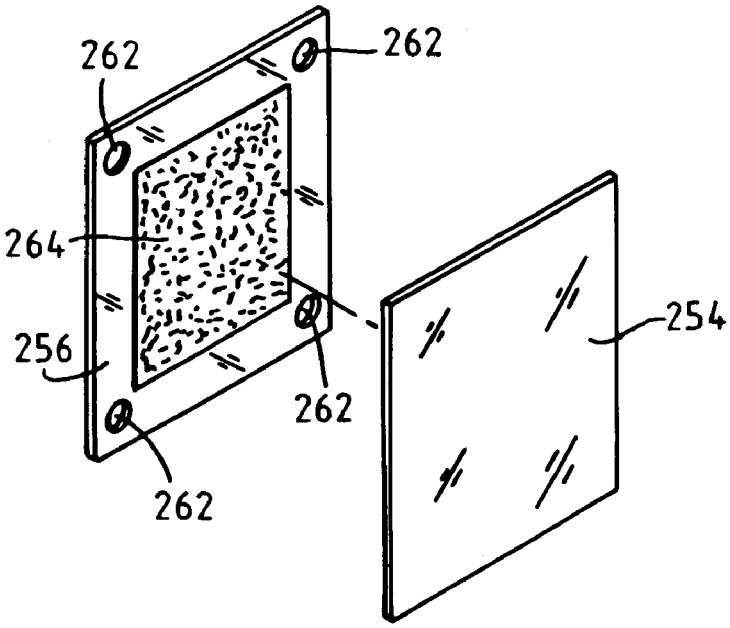
FIG. 6 is an exploded view of a second alternative embodiment of the secondary closure element.

In the alternative embodiment of FIG. 6, an adhesive layer 264 is provided on the non-porous layer 256 in a position adjacent the porous layer 254. In so doing, the two layers 254 and 256 are not joined only by surface tension upon contact with liquid, but by the adhesive layer 264 as well. The adhesive layer 264 may be provided in the form of water-sensitive adhesive such that it activates upon contact with water. The adhesive may include a water-sensitive material such as polyvinyl alcohol, cellulose, or water sensitive gum (such as guar gum). In other embodiments, other types of adhesive, such as those which activate upon contact with certain other liquids, or at a certain temperature, can be employed as well.

Figure 7:
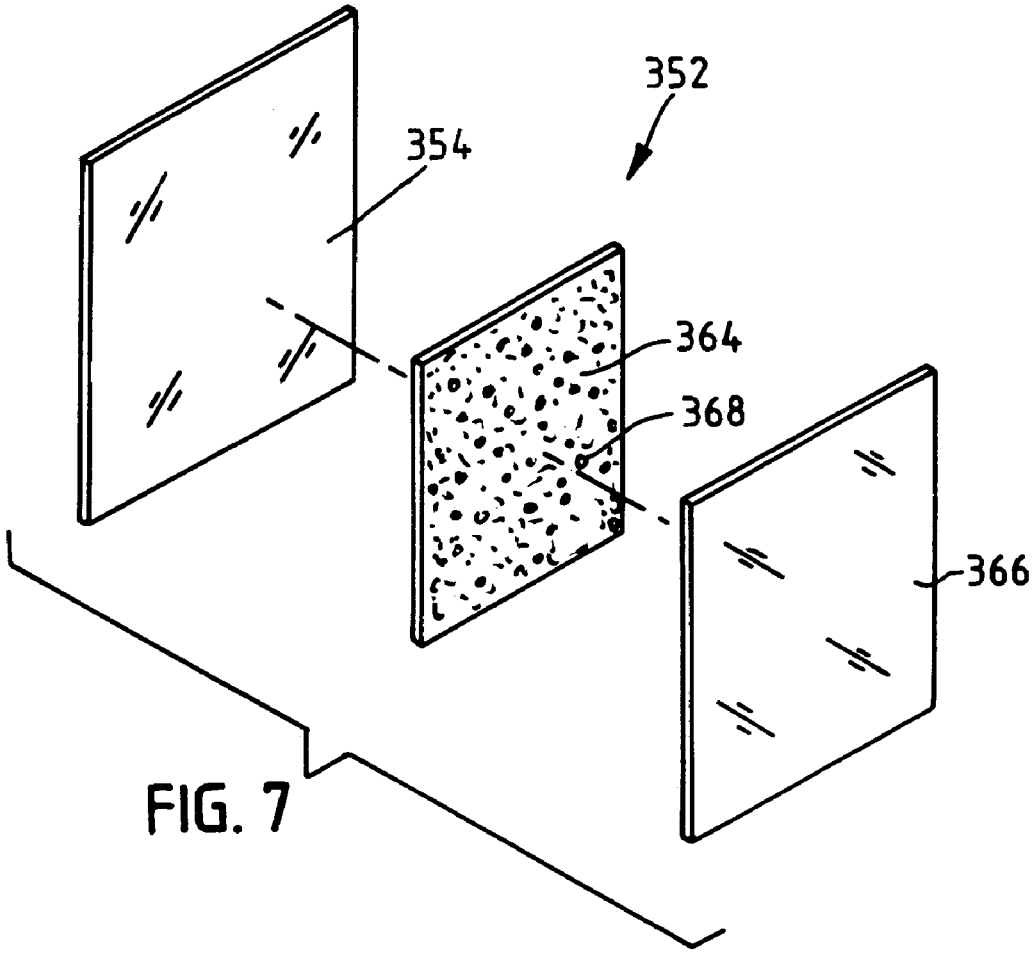
FIG. 7 is an exploded view of a third alternative embodiment of the secondary closure element.
Figure 8:
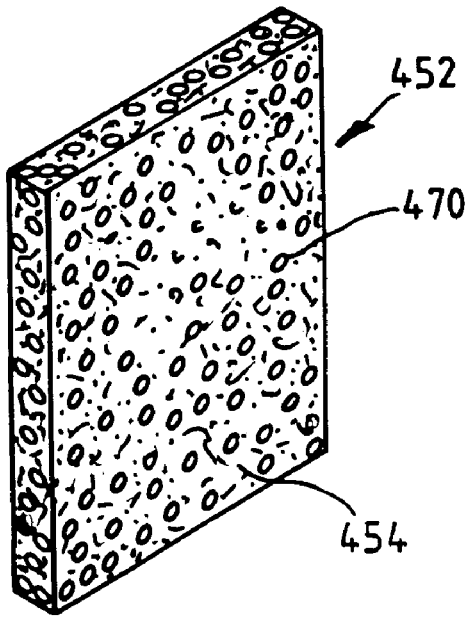
FIG. 8 is a perspective view of a fourth alternative embodiment of the secondary closure element.

In yet another alternative embodiment, depicted in exploded fashion in FIG. 7, the non-porous layer can be avoided. More specifically, the secondary closure element 352 can be provided in the form of a first porous layer 354, a second porous layer 366, and an adhesive layer 364 therebetween. The adhesive layer 364 may include a plurality of perforations 368. When such a secondary closure element 352 is not exposed to liquid, the gas contained with the bag can exit through the bag aperture and pass first through the first porous layer 354, then through the perforations 368 in the adhesive layer 364, and then through the second porous layer 366 to the atmosphere. However, upon contact with liquid, the adhesive becomes active thereby joining the first and second porous layers 354, 366 and plugging the perforations 368. The liquid is thereby prevented from exiting the bag 320.

In a still further embodiment, the secondary closure element 452 can be provided in the form of a porous layer 454 provided with absorbent or super absorbent particles 470 embedded, or otherwise provided, therein. Gas within the bag 420 is able to exit through the aperture 450 and through porous layer 454. When liquid attempts to exit through the aperture, the superabsorbent particles absorb the liquid and thereby prevent the liquid from exiting the bag 420.

From the foregoing, it will be readily understood by those of ordinary skill in the art that the teachings of this disclosure can be used to construct a recloseable storage bag having a primary closure member for closing the bag, and a secondary closure member for evacuating gas from the bag after primary closing.

What is claimed is:

1. A reclosable storage bag, comprising:

a first side having a bottom edge, left edge, right edge, and top edge:

a second side having a bottom edge, left edge, right edge, and top edge, the bottom edges of the first and second sides being attached, the left edges of the first and second sides being attached, and the right edges of the first and second sides being attached;

primary closure members provided proximate the top edges of the first and second sides;

an aperture in at least one of the first and second sides; and a secondary closure element associated with the aperture, the secondary closure element being impervious to the passage of liquid, the secondary closure element including a layer of liquid sensitive material sandwiched between first and second layers of porous material, the layer of liquid sensitive material having a first state when not exposed to liquid which allows gas flow from the first layer of porous material to the second layer of liquid sensitive material, and a second state when exposed to liquid that prevents liquid flow film the first layer of porous material to the second layer of porous material.

2. The storage bag of claim 1, wherein the liquid sensitive material is an adhesive layer.

3. The storage bag of claim 2, wherein the adhesive layer is perforated.

4. The storage bag of claim 1, wherein the porous material is manufactured of foam.

5. The storage bag of claim 4, wherein the foam is manufactured from polyethylene.

6. The storage bag of claim 5, wherein the polyethylene is manufactured to have an open cell structure.

7. The storage bag of claim 5, wherein the polyethylene is manufactured to have a closed cell structure and is subsequently punctured to form an open cell structure.

8. The storage bag of claim 1, wherein the porous material is made of non-woven polyethylene.

9. The storage bag of claim 8, wherein the non-woven polyethylene is made of one of spun bond, melt blown, and spun bond-melt blown-spun bond polyethylene.

10. The storage bag of claim 8, wherein the non-woven polyethylene has a basis weight in the range of 0.1 OSY to 50 OSY.

11. The storage bag of claim 1, wherein the liquid sensitive material is selected from a group of materials consisting of polyvinyl alcohol, cellulose, and water sensitive gums.

12. The storage bag of claim 11, wherein the water sensitive gum is guar gum.

* * * * *

UNITED STATES PATENT AND TRADEMARK OFFICE

CERTIFICATE OF CORRECTION

PATENT NO. : 7,137,738 B2
APPLICATION NO. : 10/823261
DATED : November 21, 2006
INVENTOR(S) : Ketan N. Shah et al.

It is certified that error appears in the above-identified patent and that said Letters Patent is hereby corrected as shown below:

Column 6: Line 15, replace “liquid sensitive” with --porous--

Column 6: Line 17, replace “film” with --from--

Signed and Sealed this

Fifth Day of August, 2008

JON W. DUDAS
*Director of the United States Patent and Trademark Office*